US008720339B2

(12) United States Patent
Rozenblum

(10) Patent No.: US 8,720,339 B2
(45) Date of Patent: May 13, 2014

(54) WEB PRINTING, WEB PRINTERS AND RELATED SOFTWARE

(75) Inventor: Ziv Rozenblum, Cambridge, MA (US)

(73) Assignee: Hewlett-Packard Indigo B.V., Maastricht (NL)

( * ) Notice: Subject to any disclaimer, the term of this patent is extended or adjusted under 35 U.S.C. 154(b) by 1021 days.

(21) Appl. No.: 12/295,612

(22) PCT Filed: Apr. 3, 2006

(86) PCT No.: PCT/US2006/012195

§ 371 (c)(1),
(2), (4) Date: Mar. 13, 2009

(87) PCT Pub. No.: WO2007/114813

PCT Pub. Date: Oct. 11, 2007

(65) Prior Publication Data

US 2009/0217835 A1 Sep. 3, 2009

(51) Int. Cl.
*B65H 21/00* (2006.01)
*B65H 19/00* (2006.01)

(52) U.S. Cl.
USPC ..... 101/484; 101/485; 101/486; 156/388; 156/387

(58) Field of Classification Search
USPC ..... 101/484–486; 156/384, 387, 388
See application file for complete search history.

(56) References Cited

U.S. PATENT DOCUMENTS

| | | | | |
|---|---|---|---|---|
| 4,334,946 | A | 6/1982 | Kanoto | |
| 4,779,783 | A * | 10/1988 | Fischer et al. | 226/168 |
| 5,152,858 | A * | 10/1992 | Winter | 156/157 |
| 6,213,016 | B1 * | 4/2001 | Tsunashima | 101/218 |
| 6,520,080 | B1 * | 2/2003 | Fried | 101/227 |
| 6,547,179 | B1 * | 4/2003 | Klas | 242/555.3 |
| 2002/0074087 | A1 * | 6/2002 | Hashimoto | 156/362 |
| 2002/0104450 | A1 * | 8/2002 | Weijenborg | 101/228 |
| 2005/0056719 | A1 * | 3/2005 | Tafel | 242/555.3 |
| 2008/0023126 | A1 * | 1/2008 | Hould et al. | 156/157 |

FOREIGN PATENT DOCUMENTS

| | | | |
|---|---|---|---|
| DE | 8625712 | | 10/1987 |
| DE | 4107798 | C1 | 10/1992 |
| DE | 19612416 | A1 | 10/1997 |
| JP | 61064477 | A | 4/1986 |
| JP | 63306150 | A | 12/1988 |
| JP | 11246091 | A | 9/1999 |
| JP | 2003211796 | A | 7/2003 |
| JP | 2005231062 | A | 9/2005 |

OTHER PUBLICATIONS

PCT Search Report for PCT Application No. PCT/US2006/012195, mailed Dec. 27, 2006 (12 pages).
PCT Search Report for PCT Application No. PCT/US2006/012195, mailed Oct. 16, 2008 (8 pages).

* cited by examiner

*Primary Examiner* — David Banh

(57) ABSTRACT

A method of printing on a web of substrate (510) using a web printer (610) comprising:

interrupting a first print operation on a first substrate (512);

attaching a second substrate (514) to the first substrate (512); and continuing the first print operation on the first substrate (512).

12 Claims, 5 Drawing Sheets

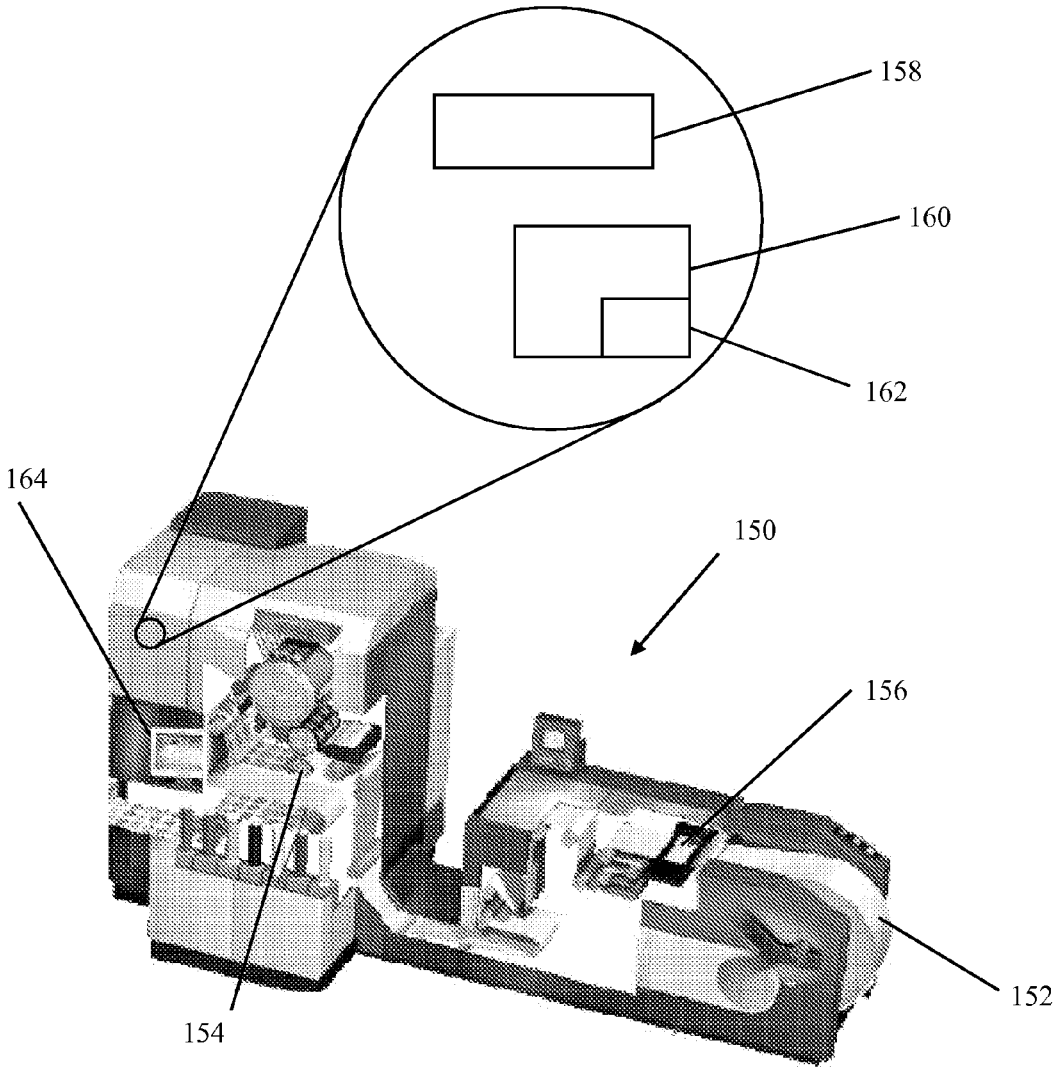
Figure 3
Figure 4
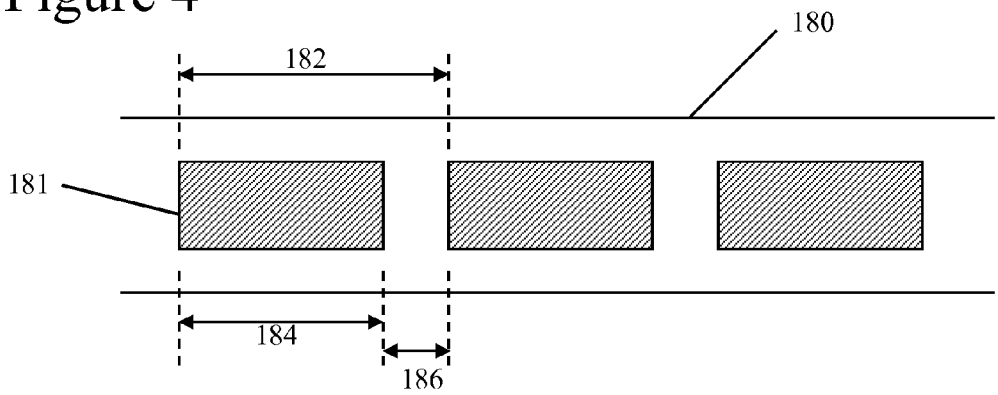

WEB PRINTING, WEB PRINTERS AND RELATED SOFTWARE

RELATED APPLICATIONS

This application claims priority to, and is a US National Phase of, International Patent Application No. PCT/US2006/012195, having title "Web Printing, Web Printers and Related Software", having been filed on 3 Apr. 2006 and having PCT Publication No. WO2007/114813, commonly assigned herewith, and hereby incorporated by reference.

BACKGROUND

Known web printers and known web printing operations can cause a large amount of web substrate and time to be wasted when the web substrate is changed between print operations. For example when changing the colour, weight or texture of paper that is to be printed upon. Short print runs, with frequent changes of web substrate between print runs, increase this waste and thus bring this issue to the fore.

Web printers have a bonding area in the printer where the web substrate of the next substrate to be printed upon is spliced to the web substrate of the previous substrate, and an image transfer area where ink is applied to the substrate. There is often a relatively long length of web between the bonding area and the image transfer area. Web substrate is manually threaded through the printer between the bonding area and the image transfer area after a first print operation has been performed on a first substrate and before a second print operation is performed on a second substrate, in order to bring the second substrate to the image transfer area.

BRIEF DESCRIPTION OF THE DRAWINGS

Various examples of the invention will now be described, by way of example only, with reference to the accompanying drawings of which:

FIG. 3 shows a web printer of an embodiment of the invention;

FIG. 4 shows a printed web according to an embodiment of the invention;

DETAILED DESCRIPTION OF SOME EXAMPLES OF THE INVENTION

Web printers are known to perform a print run (also known as a print operation) on a roll of a web of substrate. The substrate is typically paper however other materials, such as for example plastic film or a laminate material, that are suitable for web printing can be used. A print operation can comprise of printing a number of copies of the same image on the web, each sheet having a copy of the same image on it. A print job may also comprise a plurality of different images, each sheet having a different image. The web will usually be cut up into separate sheets later. It will be appreciated that by "images" it is meant to include any printed indicia including, but not limited to, words, text, pictures, drawings, photographs, representations of photographs, artwork, borders, lines, and decorative features. These images can also be considered to be "prints"

Figure 1:
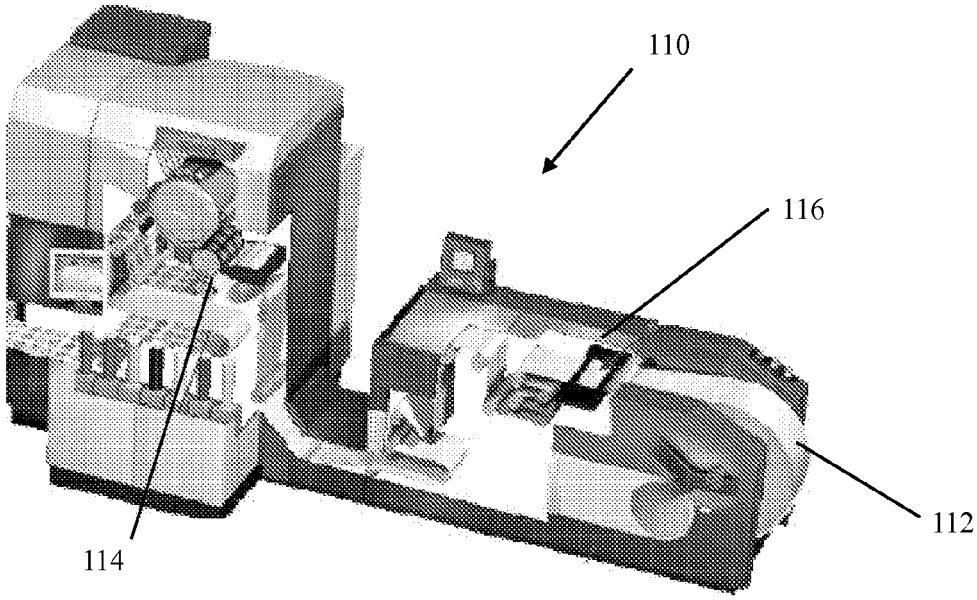
FIG. 1 shows a prior art web printer.

FIG. 1 shows a prior art web printer 110. A roll of a web of substrate 112 is shown at one end of the printer 110, and a printing or image transfer area 114 is located at the other end of the printer 110. The physical act of applying ink to the substrate is performed at the image transfer area 114. It will be appreciated that the term "ink" covers all means of forming an image on the substrate. For example, the term "ink" includes, for example, liquid dyes and dry powders.

When it is desired to replace a roll of first substrate, for example when a roll of substrate 112 is finished, or the last image of a print operation on the first substrate has been completed, the substrate is cut (if required) to detach a portion of the first substrate from the roll 112. The detached portion of first substrate is in a substrate flow-path within the printer and has a free-end where it has been cut. The roll of first substrate is then removed from the printer 110. A roll of second substrate can then be inserted into the printer 110 and the second substrate is unrolled from the roll until a free-end of the second substrate is in the vicinity of the free-end of the detached portion of first substrate. The free-end of the second substrate can then be spliced/bonded onto the free-end of the detached portion of the first substrate.

A bonding area 116 is located between the roll of substrate 112 and the image transfer area 114, and the bonding area 116 is where the portion of the first substrate is detached from the roll of first substrate and subsequently spliced/bonded to the second substrate.

The two substrates are typically bonded together with adhesive tape, although it will be appreciated that the two substrates could be bonded together in any suitable way, for example using glue. The first and second substrates are then manually fed through (threaded through) the printer to pull the second substrate through the printer until the adhesive tape passes the image transfer area, therefore avoiding printing on the adhesive tape. A second print operation can then be performed on the second substrate.

The bonding area 116 is usually positioned near the input roll 112 to avoid having manually to thread the second substrate through the printer 110 to the area where it will be spliced to the first substrate. Manually threading the second substrate through the printer 110 is more difficult if it is not already attached to the first substrate, which can be used to pull the second substrate through.

It will be appreciated that threading the substrate through the printer involves moving the substrate through the printer in the direction of a print operation by any suitable means, and may involve a user pressing a "feed" button on the printer that causes the movement, turning a wheel in order to move the substrate through the printer, or any other means.

In a typical web printer, for example the HP Indigo ws4050 digital press, the distance along the flow-path of the web between the bonding area 116 and the image transfer area 114 is about 10 meters. It typically takes about 1 to 1½ minutes to thread the web from the bonding area 116 to the image transfer area 114.

Figure 2:
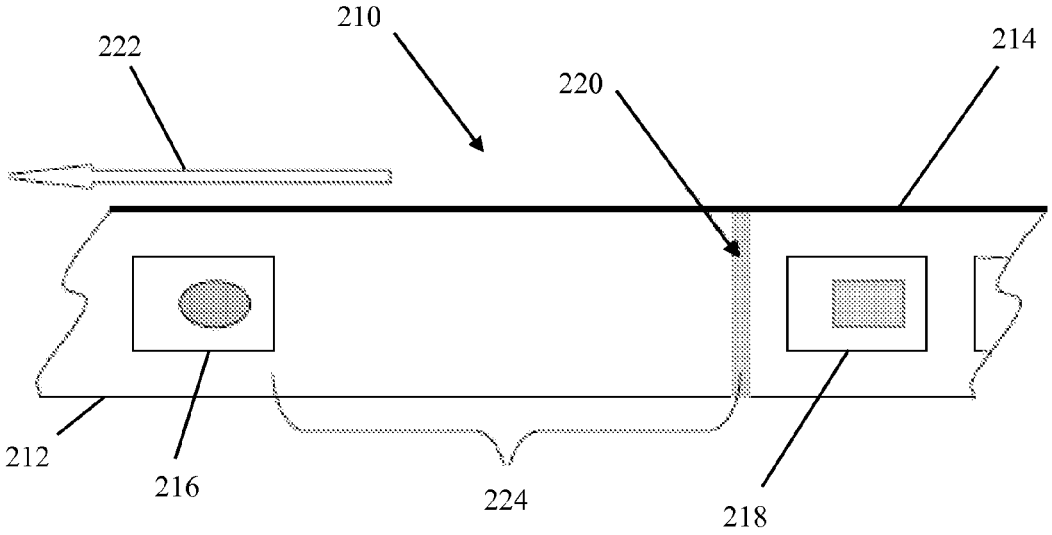
FIG. 2 shows schematically a prior art printed web.

FIG. 2 shows a prior art printed web 210. The web comprises of a first substrate 212 and a second substrate 214 that have been spliced together with adhesive tape 220 as discussed above. The print direction is indicated by arrow 222.

The last image 216 of a first print operation on the first substrate 212 is shown on the left-hand side of the web 210, and a first image 218 of a second print operation on the second substrate 214 is shown on the right-hand side of the web 210. The blank substrate between the last image 216 of the first print operation and the first image 218 of the second print operation is substrate that has been manually threaded through the printer between the first and second print operations. It will be appreciated that the first and second print operations may comprise of one or more images, and that only one image of each operation is shown in FIG. 2 to aid clarity.

A gap 224 of blank first substrate exists between the end of the last image 212 and the adhesive tape 220, and this gap 224 is the amount of substrate that is wasted when the substrate to be printed on is changed. The length of second substrate between the adhesive tape 220 and the first image 218 of the second print operation is manually threaded through the printer by an operator in order to avoid inadvertently printing on the adhesive tape, and is a lot smaller than the waste gap 224. The length of second substrate between the adhesive tape 220 and the first image 218 of the second print operation is selected to be left blank by an operator such that the print operation can be performed successfully and reliably, without risk of printing on the tape 220. The length of the waste gap 224 is equal to the distance traveled by the web 210 between the bonding area and the image transfer area of the printer.

Short run applications can have, for example, an average of about 100 meters for each print operation on a different substrate and typically takes about 10 to 20 minutes, or maybe 40 minutes to complete the actual printing operation. A typical waste gap of 10 meters and wasted time in threading the web to a position where the new web substrate is at the image transfer area of 1 minute causes losses of about 10% of the total substrate usage and 2-10% of operational time of the printer.

A typical roll of paper substrate can cost about US$1,000 per roll, and a web-printing machine may be capable of printing two complete rolls of paper in a day. In this scenario US$200 worth of substrate is wasted per day. In other scenarios where the web substrate is changed more frequently, as much as US$500 worth, or more, of substrate may be wasted per day. It will also be appreciated that the time spent manually threading substrate through the printer 110 is time that could be spent performing a print operation, and that there are associated costs lost on overheads etc.

This situation is common in web printing machines, but its impact is often higher in digital machines, since the print operations are typically a lot shorter and therefore the substrate is replaced more often.

FIG. 3 shows a web printer 150 of an embodiment of the present invention. In some embodiments, the web printer 150 is a digital printer. A roll of a web of substrate 152 is shown at one end of the printer 150, and a printing region or image transfer area 154 is located at the other end of the printer 150. A print head (not shown) applies ink to the substrate at the image transfer area 154. A web-joining region or bonding area 156 is located between the roll of substrate 112 and the image transfer area 114. A web feed mechanism is arranged to feed web through the printer 150 from the roll of substrate 152 to the printing region 154 for printing upon. In some embodiments, the same or a different web feed mechanism is arranged to feed the substrate from the printing region 154 to a cutting station where the web is cut into sheets of a predetermined size. Not all printers will have a cutting station.

The printer further comprises an operator display screen 164 which can display information in relation to the printer 164, and/or one or more print operations for example, to an operator. The operator display screen 164 may be part of a lap-top computer in communication with the printer 150. In some embodiments the user display screen can also allow a user to provide input to the printer 150, for example, by a mouse and/or keyboard (not shown) connected to the display screen 164. In other embodiments, the operator display screen 164 may be touch sensitive.

The printer 150 further comprises a computer control processor 158 and a computer memory 160. It will be appreciated that the processor 158 and memory 160 may be integral within the printer 150, and in other embodiments the processor 158 and memory 160 may be external to the printer 150 and in communication with the printer 150.

The control processor 158 is arranged to control the print head and web feed mechanism.

During a first print operation on a first web substrate, the computer processor 158 interrupts the print operation so that the first web substrate is static within the printer 150. The reason for this is that it has been appreciated that the web material between the printing region 154 and the web joining region 156 should be printed upon and not left as waste. A new web substrate is attached to the existing web substrate and the print run resumed, to print upon that part of the first substrate that was previously simply threaded through the printer unprinted.

In some embodiments the computer processor 158 can run a software algorithm to determine when to interrupt the first print operation to allow the attachment of the new web substrate to the old web substrate. The algorithm may use data stored in computer memory 160 to determine the length of substrate that is required to complete the first print operation, (bearing in mind how many more prints are to be printed, and the repeat distance between prints) and compare this with the physical distance between the bonding area 156 and the image transfer area 154 of the printer 150 such that the remainder of the print operation can be subsequently performed on the portion of substrate that is static between the bonding area 156 and image transfer area 154 whilst the print operation is interrupted.

FIG. 4 illustrates schematically parameters of the print operation that may be used to determine the length of substrate that is required to complete the first print operation after the second web substrate has been attached to the existing, first web substrate. FIG. 4 shows schematically a representation of a substrate 180 of an embodiment of the present invention that shows three identical images 181 that remain to be printed. A repeat length 182 is shown that indicates the length of substrate 180 occupied by a single image 181 before it is repeated. The repeat length 182 comprises of the summation of the length 184 of the image 181, and the length of the gap 186 between successive images 181. In other embodiments there may be no gap at all between successive images.

In some embodiments the images need not be identical, and need not have the same dimensions as other images within the print operation. As long as the computer processor and/or computer software knows the dimensions of the images that remain to be printed by the print operation, and the length of any gaps to be left between item, the length of substrate that is required to complete the first print operation can be calculated. As will be appreciated, what is actually done is to calculate, from the knowledge of how many of the remaining prints will fit into the web that extends between the printing region and the web bonding region, when to stop the print operation and attach the second web to the first web.

Returning to FIG. 3, in embodiments where the print operation where identical images are printed the computer software can use the repeat length for images of the print operation to determine the length of substrate that is required to complete the first print operation. The repeat length can be stored in computer memory 160, or the number of images that can be printed upon the length of web between the web bonding region and the printing region after splicing to the new web can be stored. The processor can then stop the printing operation with the right number of prints remaining, the new web can be attached to the existing web, and the remainder of the prints printed onto the last bit of the old web.

In some embodiments the parameters of a print operation may be stored in a database 162 in the computer memory 160, and the data may be retrieved from the database 162 by the computer processor 158 when it is required.

The distance of the substrate flow-path between the bonding area and the image transfer area may also be stored in computer memory 160, and may be stored in the database 162. In embodiments where a safety margin is left between the end of the first print operation and the end of the first substrate, the length of the safety margin may also be stored in computer memory 160, and may be stored in the database 162 (or the length of old web available for printing after web bonding/splicing may be stored pre-adjusted for a safety margin—i.e a shorter length than the length of the flow path could be stored).

Whilst the print operation is interrupted, the substrate can be cut (if required) to detach a portion of the first substrate from the roll 152. The detached portion of first substrate is in a substrate flow-path within the printer and has a free-end in the vicinity of the bonding area 156 of the printer 150.

The roll of first substrate is then removed from the printer 110. A roll of a second substrate can then be inserted into the printer 110 and the second substrate is unrolled from the roll until a free-end of the second substrate is in the vicinity of the free-end of the detached portion of first substrate in the bonding area 156 of the printer 150. The free-end of the second substrate can then be spliced/bonded onto the free-end of the detached portion of the first substrate.

The two substrates are typically bonded together with adhesive tape, although it will be appreciated that the two substrates could be bonded together in any suitable way, for example using glue.

Once the two substrates have been attached together an operator can use an operator input control, for example the operator display screen 164 (if it is a touch screen) or a periphery input device connected to the processor 158 to indicate to the printer 150 that the two substrates have been attached to each other and/or that printing should recommence. The act of the operator pressing a button, or otherwise indicating that the attachment has been completed, can cause the computer processor 158 to instruct the printer 150 to continue the first print operation on the first substrate.

In some embodiments, such as the one described above, the first print operation is completed on the first substrate before the bonded region where the first and second substrates have been attached together reaches the image transfer area 154. The first and second substrates are automatically fed through the printer after completion of the first print operation to pull (thread) the second substrate through the printer until the bonded region passes the image transfer area. This avoids printing on the bonded region itself. A second print operation can then be performed on the second substrate after the bonded region.

In other embodiments, the print operations may be set-up in such a way that it does not matter whether or not an image is printed upon a bonded region between substrates, for example on adhesive tape joining the two substrates together. A print operation may be configured such that a surplus number of images, that is in addition to the required number of images for a print job, are printed. If some of these are unusable because they have been printed on an unusable region of substrate it may not matter, as enough acceptable images have been printed on other regions of substrate. Not all embodiments avoid printing on the adhesive joining tape.

Figure 5:
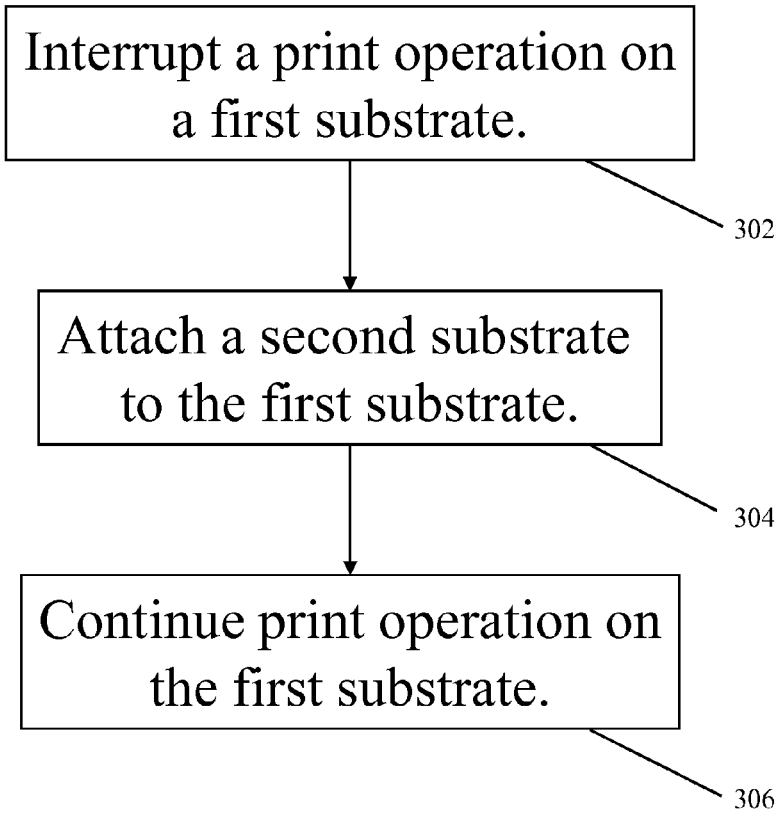
FIG. 5 shows a flow chart of a method according to an embodiment of the invention.

FIG. 5 shows a flow chart of steps performed by a method of an embodiment of the invention. At step 302 a print operation that is being performed on a first substrate by a web printer is interrupted before it is finished.

In some embodiments a portion of a first substrate can then be detached from a roll of substrate. The portion of first substrate may be detached from the roll by cutting or ripping the first substrate from one side to the other in a direction that is transverse to the direction of movement of the substrate through the printer. The substrate that is downstream of the cut remains in the web printer and the substrate upstream of the cut (that is the substrate that is still on the roll) can be removed from the printer. In some embodiments, the substrate may not need to be cut—for example where all of the substrate on a roll is used up and the web substrate has a natural free edge/end anyway.

Once the first print operation has been interrupted, the printer may indicate to the user/operator that the substrate needs replacing. This may be in the form of an indicator on the operator's display, by an alarm sounding, or by any other means.

At step 304 a second substrate is attached/spliced to the first substrate, by joining the end of the detached portion of the first substrate to a free-end of the second substrate. This maybe done manually. It may be done, in other embodiments, automatically by the printer.

In some embodiments the roll of first substrate can be removed from the web printer and a roll of second substrate inserted into its place. In other embodiments a web printer may be capable of accommodating more than one roll of substrate, and rolls of substrate do no need to be removed from the printer in order to change the substrate that is to be printed upon.

At step 306 the first print operation then continues on the first substrate up until the region on the web at which the second substrate has been spliced onto the first substrate. The first print operation on the first substrate may finish before the second substrate reaches the printing region where ink is transferred onto the substrate.

In some embodiments, a second print operation can then continue on the second substrate after the splice. The first and second substrate may be of the same substrate material. For example, if a print run required 10000 images to be printed and only 9000 would fit onto the existing, coupled for use, web substrate roll, then a new roll (of the same substrate material) could be attached to the end of the first roll and the last 1000 images printed on the new roll. The first and second print operations may be the same print operation. However, in many embodiments they will be printing images onto different web substrates.

Figure 6:
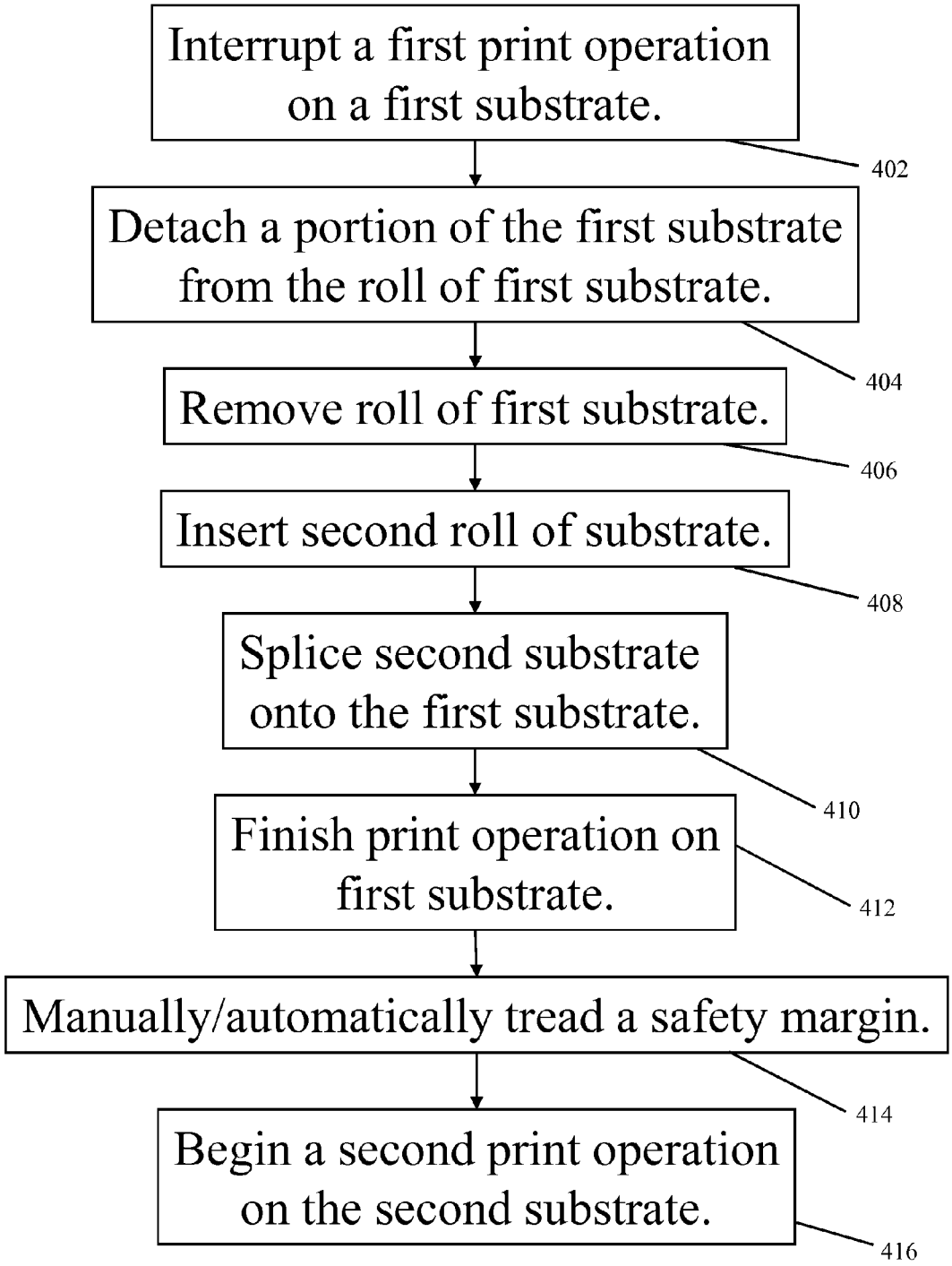
FIG. 6 shows a flow chart of a method according to an embodiment of the invention.

FIG. 6 shows a flow chart of steps performed by a method according to an embodiment of the invention. A first print operation on a first substrate is interrupted at step 402.

Computer software may automatically interrupt the print operation at a predetermined point in the print operation. The predetermined point may be when a certain number of images, or a certain length of printed images, remaining to be printed. The certain number, or certain length, of printed images may be calculated in relation to the physical distance of the paper flow-path between the bonding area where the substrate will be spliced and the image transfer area where the ink is applied to the paper. The certain number or length of printed images may correspond to the distance between the bonding area and the image transfer area, optionally less a safety margin.

The safety margin can help reduce the chances that a print operation inadvertently continues beyond the end of the appropriate substrate.

Typically, the physical distance of the paper path between the bonding area and the image transfer area may be about 10 meters and the safety margin may be of the order of about 1 meter, 0.75 meters, 0.5 meters, 0.1 meters or any distance there between. Therefore the certain length of printed images may be about 9 meters, 9.25 meters, 9.5 meters, 9.9 meters or any distance there between. The safety margin may be different for different printing machines. In some embodiments a user may be able to set the safety margin themselves.

In some embodiments there may be no safety margin at all, or a minimal one, or a safety margin that is not more than, or that is less than, the repeat length along the web of the first print run.

The computer software can determine the certain length of printed images remaining to be printed based upon known software parameters. The computer software can calculate the predetermined point to interrupt the print operation by using software parameters corresponding to some, or all, of: the length of the images to be printed within the print operation, the gap between the images, the number of images that remain to be printed in the session, the distance between the bonding area and the image transfer area, and the safety margin. The software can use this information to calculate how many images can fit in the gap between the bonding area and the image transfer area minus the safety margin, and interrupt the print operation when that number of images of the print operation remain to be printed (or when one, two, or a few, or any number, less than maximum number of remaining images remain to be printed).

In some embodiments it may not be possible to leave the exact safety margin that is desired, as there may not be an exact whole number of images that fit in the gap between the image transfer area and the bonding area less the desired safety margin. In these embodiments, the computer software may interrupt the print operation such that at least the safety margin remains after the print operation has finished. The print operation may be interrupted at a point where the physical length of the number of images of a print operation that remain to be printed is equal to, or less than, the distance between the bonding area and the image transfer area less the safety margin.

Once the first print operation has been interrupted, and the first substrate is stationary within the printer, a portion of the first substrate is detached from a roll of the first substrate in the region of a bonding area of the printer at step 404.

Detaching the portion of first substrate from the roll of first substrate exposes a free-end of the detached portion of the first substrate.

Detaching the portion of first substrate from the roll of first substrate may involve cutting the substrate from side to side, in a direction that is substantially transverse to the direction of flow of the substrate. In other embodiments the substrate may be ripped such that a portion of first substrate is detached from the roll of first substrate.

The roll of the first substrate can then be removed from the printer at step 406 (if removal is desired), and a second roll of substrate inserted into the printer at step 408 (if the printer does not already have a suitable second roll installed). The second substrate is then unwound from the roll until a free-end of the second substrate is positioned within the bonding area of the printer.

At step 410 the free-end of the second substrate on the roll is attached, e.g. spliced, to the free-end of the detached portion of first substrate. The two substrates can be spliced together by using adhesive tape, by glue, or by any other means.

Once the splicing/attaching operation has been completed, the first print operation continues on the detached portion of first substrate at step 412.

The printer may restart the first print operation in response to a signal indicative that the splicing operation has been completed. For example, a user may press a button, click a button on a graphical user interface, press a touch sensitive screen, or use any other means to indicate to computer software that the splicing operation has been completed.

The first print operation continues on the first substrate until the print operation has been completed. In accordance with the calculations that have already been performed by the computer software, the first print operation terminates at a distance equal to the safety margin, or at least the distance of the safety margin, away from the splice between the first and second substrate.

At step 414, the printer automatically without human intervention (except perhaps for an "initiate threading" instruction) threads the substrates through the printer by a predetermined distance, for example a distance equal to twice the safety margin. The printer may thread the substrate automatically, without instruction/involvement by an operator. In other embodiments an operator may press a button, rotate a wheel, or otherwise manually thread the substrate through the printer. This allows for a safety margin at the end of the first print operation on the first substrate, and a safety margin at the start of a second print operation on the second substrate. In embodiments where it is not possible to leave the exact safety margin, the printer threads the substrates through the printer by a distance equal to the distance between the last image of the print operation and the splicing point for the print operation in question, plus a distance equal to the desired safety margin for the start of the second print operation.

In some embodiments the safety margin that is required for the end of a first print operation may not be the same as the safety margin that is required for the start of a second print operation.

In some embodiments the value for the safety margin may be a single value stored in computer memory as a distance that accounts for both a safe distance to be left at the end of the first print operation and a safe distance to be left at the start of a second print operation. In such embodiments, the printer automatically threads a distance equal to the safety margin at step 414, and not a distance equal to twice the safety margin.

At step 416, a second print operation begins on the second substrate.

It will be appreciated that the method can return to an equivalent of step 402 towards the end of the second print operation so that a third substrate can be spliced to the second substrate to enable a third print operation to be performed on the third substrate, and a fourth print operation on a fourth substrate, and so on.

Figure 7:
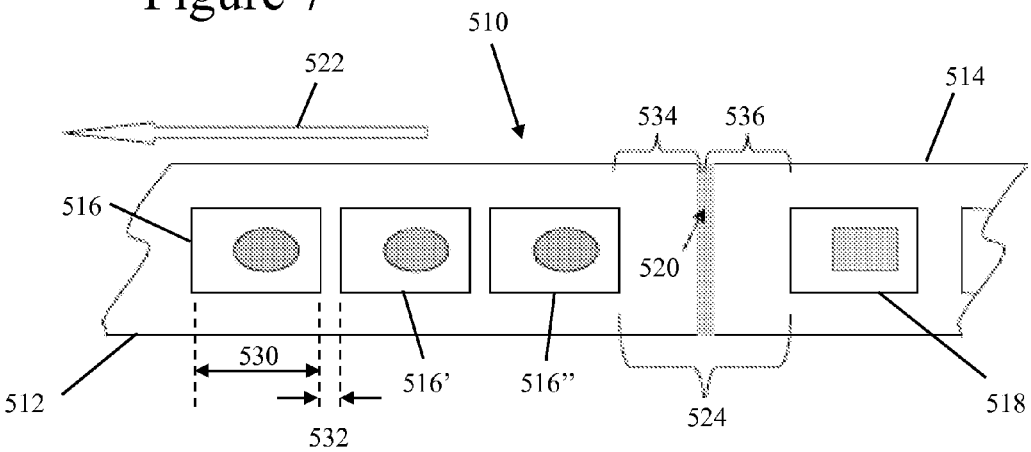
FIG. 7 shows schematically a printed web according to an embodiment of the invention.

FIG. 7 shows a printed web 510 produced using an embodiment of the present invention. The web comprises of a first substrate 512 and a second substrate 514 that have been spliced together with adhesive tape 520. The print direction is indicated by arrow 522.

The last three images 516, 516', 516" of a first print operation are shown on the first substrate 512, and the first image 518 of a second print operation is shown on the second substrate 514. There are no images printed in the region 524 of the substrates 512, 514 between the first and second print operations as this region of the substrates 512, 514 has been threaded through the printer between print operations. Region 524 comprises a safety margin 534 on the first substrate 512 and a safety margin 536 on the second substrate 514.

The web 510 has been printed upon using a method whereby the first print operation has been interrupted before it has finished in order that the second substrate 514 can be spliced to the first substrate 512 with adhesive tape 520. The position of the splice is selected so that a safety margin 534 exists between the end of the last image 516" of the first print operation and the adhesive tape 520, and can be calculated using the length 530 of the images 516, 516', 516" of the first print operation and the gap 532 between successive images 516, 516', 516".

The amount of first substrate 512 that is wasted is only that in the safety margin 534. The length of the safety margin 534 may be of the order of 1 meter, 0.75 meters, 0.5 meters, or shorter and in some embodiments can be controlled by a user/operator. Protection for a printed web, as such, is one aspect of an embodiment of the invention.

It may take about 20 seconds to thread first safety margin 534 and second safety margin 536 through the printer.

For short run applications with an average of about 100 meters for each print operation on a different substrate, and with embodiments of the invention where the safety margin is 1 meter, only 1% of substrate is wasted. This is compared with 10% of substrate in the prior art as discussed in relation to FIG. 2.

In the HP Indigo ws4050 digital press example, it only takes about 15 to 20 seconds to thread the 1 meter safety margin in an embodiment of the invention. This time is a combination of the threading time and time associated with overheads. In particular, the overhead time may be reduced by 50% in embodiments of the present invention, as the new procedure is automatic. This is compared with 1 to 1½ minutes (including overheads) to thread 10 meters in the prior art.

The time it takes to feed the substrate through the printer may not be linearly related to the length of substrate that is threaded as there may be a set amount of time associated with initiating and terminating a thread operation. The threading time is a machine parameter that is determined by several factors that may include motor speeds, safety requirements, etc. The time it takes to thread web may be different for other presses.

It can be seen that an embodiment of the invention can reduce the substrate waste by 80% to 90%, and reduce the time wasted threading substrate by 60% to 80%. More particularly an embodiment can reduce the substrate waste by 80% and the time waste by 60% to 70%. It may be that the time saved can enable more print operations to be performed in a day with fewer printers than may be required by prior art systems. There may be provided a more profitable printer compared with the prior art. A printing house may need fewer printers than in comparison with the prior art.

Taking the example of a roll of paper substrate costing US$1,000, and a web-printing machine using two rolls of substrate per day, an embodiment of the invention may only waste US$20 of substrate per day, compared with US$200 per day with a prior art system. The money that can be saved by an embodiment of the invention may be all profit for the owner of the printer and/or may enable them to offer better prices for printing.

Figure 8:
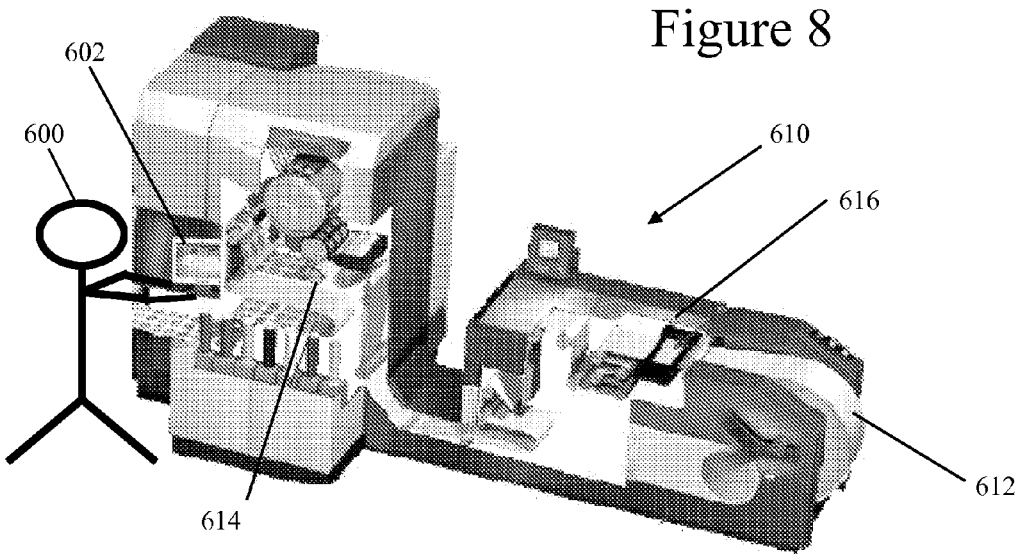
FIG. 8 shows a user updating the software of a prior art web printer to enable it to perform a method of an embodiment of the invention.

FIG. 8 shows schematically a user 600 updating the software of a prior art web printer 610 to enable the printer 610 to perform a method of an embodiment of the present invention. The printer 610 comprises a roll of substrate 612, a bonding area 616, and an image transfer area 614 as discussed in relation to FIG. 1.

The user 600 may use a laptop computer 602 attached to the printer 610 to update the software on the printer 610. The new software may be on a compact disc or digital versatile disc (or any other data carrier) that can be inserted into the laptop so that the appropriate software can be transferred across to the printer 610. In alternative embodiments the laptop, or any other computer or like device, may be remote from the printer 610 and in communication with the printer 610 by any known means.

In further embodiments still, it may be possible to load the compact disc, or the any other data carrier, directly into the printer 610 in order to enable the printer 610 to run the new software.

Advantages of embodiments of the present invention can include:

- reducing the amount of substrate that is wasted when performing web-print operations;
- reducing the amount of time that is wasted when performing web-printing operations;
- reducing the amount of time that lapses while ink is not being applied to a substrate during a web-printing operations;
- enabling a publisher to use fewer web printers to perform a print operation in a given time;
- providing a more profitable printer compared with the prior art;
- providing an algorithm that is easy to implement;
- not requiring a hardware modification in order to implement a method of the present invention;
- not requiring any extra action to be performed by an operator of the printer in order to provide advantages/savings of the invention;
- providing an economic printing mode;
- reducing the required skill level and the training time of the operator; and
- reducing variation between print jobs, thereby improving consistency. For example, two different machines can produce the same printed rolls even though different operators operate them. This can ease the automation of the rest of the process (for example, cutting, splicing etc.).

The invention claimed is:

1. A method of printing using a web printer, the method comprising:

- providing said web printer with image data for a first print operation, said first print operation comprising a plurality of images wherein said image data comprises at least length data for each of said plurality of images;
- starting said first print operation on a first substrate;
- providing said web printer with a distance between a bonding area of the web printer and an image transfer area of the web printer, wherein the image area is where ink is applied to said first substrate;
- determining a position of the first substrate where a total length of remaining images to be printed is less than or equal to said distance between a bonding area of the web printer and an image transfer area of the web printer;
- interrupting the first print operation on the first substrate at the determined position;
- attaching a second substrate to the first substrate while the first print operation is interrupted; and,
- thereafter, continuing the first print operation on the first substrate.

2. The method of claim 1 further comprising:

interrupting the first print operation such that at least a safety margin remains on the first substrate between a last image printed on the first substrate and a region of the first substrate at which the second substrate and the first substrate are joined.

3. The method of claim 1, wherein the interrupting further comprises:

interrupting the first print operation such that at least a safety margin remains between the last image of the first print operation and a region of the first substrate where the second substrate is attached to the first substrate, wherein the position of the first substrate is calculated by determining the number of complete images of the first print operation that could fit in the length of the first substrate flow-path between the bonding area and the image transfer area less the safety margin, wherein the calculation uses any number of the following software parameters;

length in the web motion direction of an image of the print operation;

length in the web motion direction of a gap between successive images;

number of images that remain to be printed in the print operation;

length of the substrate flow-path between the bonding area and the image transfer area; and length of the safety margin.

4. The method of claim 1 further comprising:

starting a second print operation on the second substrate.

5. The method of claim 4 further comprising:

threading the first and second substrates through the printer between the first and second print operations.

6. The method of claim 5 wherein the first and second substrates are threaded through the printer by a distance that includes a safety margin intended to avoid accidentally printing the second print operation on a section of the web that includes a region where the first and second substrates are joined.

7. The method of claim 1 wherein the step of attaching the second substrate to the first substrate comprises:

detaching a portion of the first substrate from a roll of first substrate;

removing the roll of first substrate from the printer;

inserting a roll of second substrate into the printer; and splicing a free-end of the second substrate to the detached portion of the first substrate.

8. The method of claim 5 wherein the step of attaching the second substrate to the first substrate comprises:

detaching a portion of the first substrate from a roll of first substrate;

removing the roll of first substrate from the printer;

inserting a roll of second substrate into the printer; and splicing a free-end of the second substrate to the detached portion of the first substrate.

9. The method of claim 6 wherein the step of attaching the second substrate to the first substrate comprises:

detaching a portion of the first substrate from a roll of first substrate;

removing the roll of first substrate from the printer;

inserting a roll of second substrate into the printer; and splicing a free-end of the second substrate to the detached portion of the first substrate.

10. A method of printing using a web printer, the method comprising:

providing said web printer with image data for a first print operation, said first print operation comprising a plurality of images wherein said image data comprises at least length data for each of said plurality of images;

starting said first print operation on a first substrate;

providing said web printer with a distance between a bonding area of the web printer and an image transfer area of the web printer, wherein the image area is where ink is applied to said first substrate;

determining a position of the first substrate where a total length of remaining images to be printed is less than or equal to said distance between a bonding area of the web printer and an image transfer area of the web printer;

interrupting the first print operation on the first substrate at the determined position;

detaching a portion of the first substrate from a roll of first substrate in the vicinity of the bonding area of the printer;

removing the roll of first substrate from the printer;

inserting a roll of second substrate into the printer;

splicing the detached portion of the first substrate to the second substrate in the vicinity of the bonding area of the printer while the first print operation is interrupted;

continuing the first print operation on the first substrate;

threading the first and second substrates through the printer; and starting a second print operation on the second substrate.

11. A web printer having:

a print region comprising a print head;

a web-joining region;

a web feed movement mechanism for feeding web past the print region for printing thereupon;

a control processor arranged to control the print head and web feed mechanism;

a memory accessible by the control processor and containing first data relating to a plurality of images to be printed in a first print operation and second data relating to the distance between the web-joining region and the print region;

wherein the first data includes at least length data for each of the plurality of images; and wherein the control processor starts the first print operation on a first substrate, determines a position of the first substrate where a total length of remaining images to be printed is less than or equal to said distance between the web-joining region and the print region, interrupts the first print operation at the determined position; attaches a second substrate to the first substrate while the first print operation is interrupted and continues the first printing operation on the first substrate.

12. The web printer of claim 11 wherein the memory also contains data relating to the print repeat length occupied by two adjacent prints and wherein the control processor prints the remaining prints of the first print run onto the first web substrate.

* * * * *

UNITED STATES PATENT AND TRADEMARK OFFICE

CERTIFICATE OF CORRECTION

PATENT NO. : 8,720,339 B2
APPLICATION NO. : 12/295612
DATED : May 13, 2014
INVENTOR(S) : Ziv Rozenblum It is certified that error appears in the above-identified patent and that said Letters Patent is hereby corrected as shown below:

In The Claims

In column 11, line 17, in Claim 3, delete “the” and insert -- than the --, therefor.

In column 12, line 37, in Claim 11, delete “thereupon;” and insert -- upon; --, therefor.

Signed and Sealed this
Seventh Day of June, 2016

Michelle K. Lee

Michelle K. Lee
*Director of the United States Patent and Trademark Office*